US009470078B2

(12) United States Patent
Gonzalez

(10) Patent No.: US 9,470,078 B2
(45) Date of Patent: Oct. 18, 2016

(54) FLUID DIVERSION THROUGH SELECTIVE FRACTURE EXTENSION

(71) Applicant: BAKER HUGHES INCORPORATED, Houston, TX (US)

(72) Inventor: Angel F. Gonzalez, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/499,543

(22) Filed: Sep. 29, 2014

(65) Prior Publication Data

US 2016/0090829 A1 Mar. 31, 2016

(51) Int. Cl.
*E21B 43/26* (2006.01)

(52) U.S. Cl.
CPC ..... *E21B 43/26* (2013.01)

(58) Field of Classification Search
None
See application file for complete search history.

(56) References Cited

U.S. PATENT DOCUMENTS 3,960,736 A * 6/1976 Free ..... C09K 8/62 166/275
6,047,773 A * 4/2000 Zeltmann ..... E21B 21/14 166/281
6,367,548 B1 * 4/2002 Purvis ..... E21B 43/25 166/250.01
6,394,184 B2 * 5/2002 Tolman ..... E21B 17/203 166/120
7,575,062 B2 * 8/2009 East, Jr. ..... E21B 33/1208 166/305.1
2003/0060374 A1 * 3/2003 Cooke, Jr. ..... C09K 8/62 507/200
2006/0175059 A1 * 8/2006 Sinclair ..... C09K 8/805 166/283
2006/0283592 A1 * 12/2006 Sierra ..... C09K 8/50 166/281
2007/0023184 A1 * 2/2007 Jackson ..... E21B 43/267 166/250.07
2008/0000639 A1 * 1/2008 Clark ..... E21B 43/14 166/281
2009/0151938 A1 * 6/2009 Conkle ..... E21B 43/26 166/254.1
2010/0065276 A1 * 3/2010 Fehr ..... E21B 33/124 166/308.1
2011/0067870 A1 * 3/2011 East, Jr. ..... E21B 33/124 166/298
2011/0120718 A1 * 5/2011 Craig ..... E21B 43/16 166/308.1
2014/0138087 A1 * 5/2014 Gupta ..... C04B 26/28 166/281
2014/0262231 A1 * 9/2014 Alam ..... E21B 43/28 166/250.01
2014/0262283 A1 * 9/2014 Savari ..... E21B 43/25 166/305.1

* cited by examiner

*Primary Examiner* — Angela M DiTrani
*Assistant Examiner* — Anuradha Ahuja
(74) *Attorney, Agent, or Firm* — Parsons Behle & Latimer

(57) ABSTRACT

A system and method that uses fluid diversion to selectively re-fracture a location of a multizone horizontal wellbore. A tubing string is extended from the surface to a location within the wellbore that is to be re-fractured. The annulus between the tubing string and the wellbore contains a first fluid and a second fluid is contained within the tubing string. The annulus may be sealed off at or near the surface and the second fluid is pumped out of the tubing string to initiate the re-fracture of the first location. The annulus seal may then be unset and the first fluid may be pumped down the annulus simultaneous to pumping a third fluid down the tubing string to re-fracture the first location. After re-fracturing the first location, the first location may be hydraulically isolated from the wellbore to permit a second location to be re-fractured.

20 Claims, 12 Drawing Sheets

FLUID DIVERSION THROUGH SELECTIVE FRACTURE EXTENSION

BACKGROUND

1. Field of the Disclosure

The embodiments described herein relate to a system and method for re-fracturing select locations, such as prior perforations, prior fractures, and/or prior fracture clusters, of the formation of a multizone horizontal wellbore, also referred to as a high angle wellbore, hereinafter referred to as a horizontal wellbore. The formation may also re-fracture the formation through a sliding sleeve left open during a prior hydraulic fracturing process.

2. Description of the Related Art

Natural resources such as gas and oil may be recovered from subterranean formations using well-known techniques. For example, a horizontal wellbore may be drilled within the subterranean formation. After formation of the horizontal wellbore, a string of pipe, e.g., casing, may be run or cemented into the well bore. Hydrocarbons may then be produced from the horizontal wellbore.

In an attempt to increase the production of hydrocarbons from the wellbore, the casing may be perforated and fracturing fluid may be pumped into the wellbore to fracture the subterranean formation. The fracturing fluid is pumped into the well bore at a rate and a pressure sufficient to form fractures that extend into the subterranean formation, providing additional pathways through which fluids being produced can flow into the well bores. The fracturing fluid typically includes particulate matter known as a proppant, e.g., graded sand, bauxite, or resin coated sand, may be suspended in the fracturing fluid. The proppant becomes deposited into the fractures and thus holds the fractures open after the pressure exerted on the fracturing fluid has been released.

Another method to increase the production of hydrocarbons from a horizontal wellbore is to attempt to fracture the formation through ported collars or tubulars within the horizontal wellbore. Typically, these ported collars may be selectively closed by a sliding sleeve, which may be actuated to an open position by various means such as by the use of a shifting tool or by the application of a pressure differential. Once the port is opened, fracturing fluid may be pumped down the well and out the port in an attempt to fracture the formation to increase production of hydrocarbons.

A production zone within a wellbore may have been previously fractured, but the prior fracturing may not have adequately fractured the formation leading to inadequate production from the production zone. Even if the formation was adequately fractured, the production zone may no longer be producing at adequate levels. Over an extended period of time, the production from a previously fractured horizontal wellbore may decrease below a minimum threshold level. One technique in attempting to increase the hydrocarbon production from the wellbore is the addition of new fractures within the subterranean formation. One potential problem in introducing new fractures in the formation is that fracturing fluid pumped into the wellbore may enter prior fractures formed in the subterranean formation instead of creating new fractures. Expandable tubulars or cladding procedures have been used within a wellbore in an attempt to block the flow path of the fracturing fluid to the old fractures, instead promote the formation of new fracture clusters. The use of expandable tubulars or cladding may not adequately provide the desired results and further, may incur too much expense in the effort to increase products from the wellbore. A more efficient way to increase the production of a horizontal wellbore may be needed.

SUMMARY

The present disclosure is directed to a method and system of re-fracturing production zones of a horizontal wellbore that overcomes some of the problems and disadvantages discussed above.

One embodiment is a method of re-fracturing a horizontal wellbore formation comprising positioning an end of a tubing string adjacent a first location within a horizontal wellbore, the first location having been previously hydraulically fractured at least once, the tubing string extending from a surface location to the first location. The method comprises providing a first fluid in an annulus between the tubing string and the horizontal wellbore, wherein a portion of the horizontal wellbore beyond an end of the tubing string includes the first fluid. The method comprises providing a second fluid within the tubing string, wherein the second fluid differs from the first fluid. The method comprises sealing the annulus adjacent to the surface location and pumping the second fluid down the tubing string to initiate a re-fracture of the first location while the annulus is sealed adjacent to the surface location.

The method may include unsealing the annulus adjacent to the surface location after initiating the re-fracture of the first location. The method may include pumping the first fluid down the annulus between the tubing string and the wellbore to re-fracture the first location and pumping a third fluid down an interior of the tubing string to re-fracture the first location, wherein the first fluid is pumped down the annulus and the third fluid is pumped down the tubing string after unsealing the annulus. The method may include monitoring the first location with a microseismic device and determining an effectiveness of the re-fracturing based on data from the microseismic device. The third fluid may be the same fluid as the first fluid.

The method may include hydraulically isolating the first location from the horizontal wellbore after being re-fractured by the first fluid and the third fluid. Hydraulically isolating the first location may comprise forming a plug within the horizontal wellbore adjacent the first location. Fluid may be pumped down the tubing string to form the plug. The method may include positioning the end of the tubing string adjacent a second location within the horizontal wellbore, the second location having been previously hydraulically fractured at least once, the tubing string extending from the surface location to the second location. The method may include providing the first fluid in the annulus between the tubing string and the horizontal wellbore and providing the second fluid within the tubing string, wherein the second fluid differs from the first fluid. The method may include sealing the annulus adjacent to the surface location and pumping the second fluid down the tubing string to initiate a re-fracture of the second location while the annulus is sealed adjacent to the surface location.

The method may include unsealing the annulus adjacent to the surface location after initiating the re-fracture of the second location. The method may include pumping the first fluid down the annulus to re-fracture the second location and pumping the third fluid down the tubing string to re-fracture the second location, wherein the first and third fluids are pumped after unsealing the annulus. The method may include hydraulically isolating the second location from the horizontal wellbore after being re-fractured by the first fluid and the third fluid. The method may include removing the isolation of the first location, removing the isolation of the second location, and producing hydrocarbons from the first and second locations.

One embodiment is a system for re-fracturing a multizone horizontal wellbore comprising a tubing string positioned within a multizone horizontal wellbore, the tubing string extends from a surface location with an end being positioned adjacent to a first location in the multizone horizontal wellbore, the first location being a previously hydraulically fractured location. The system comprises a sealing element configured to selectively create a seal in an annulus between the tubing string and the wellbore, the seal being adjacent the surface location. The system comprises a first fluid in the annulus and in a portion of the wellbore beyond the end of the tubing string and a second fluid within an interior of the tubing string, wherein the second fluid is pumped out the end of the tubing string to initiate a re-fracture of the first location. The system comprises a third fluid within the interior of the tubing string, the third fluid replacing the second fluid, wherein the first fluid is pumped down the annulus and the third fluid is pumped down the tubing string to re-fracture the first location. The system comprises a first plug positioned adjacent the first location after being re-fractured by the first fluid and the third fluid.

The first fluid of the system may have a viscosity of at least ten centipoise. The first fluid may have a first viscosity, the second fluid may have a second viscosity, and the first viscosity may be at least five centipoise higher than the second viscosity. The first fluid may have a first viscosity, the second fluid may have a second viscosity, and the third fluid may have a third viscosity, wherein the third viscosity may be the same as the first viscosity, which may be at least five centipoise higher than the second viscosity. The tubing string may be a coiled tubing string. The first fluid may be a linear gel. The system may include a microseismic device configured to monitor the re-fracturing of the first location.

Figure 1:
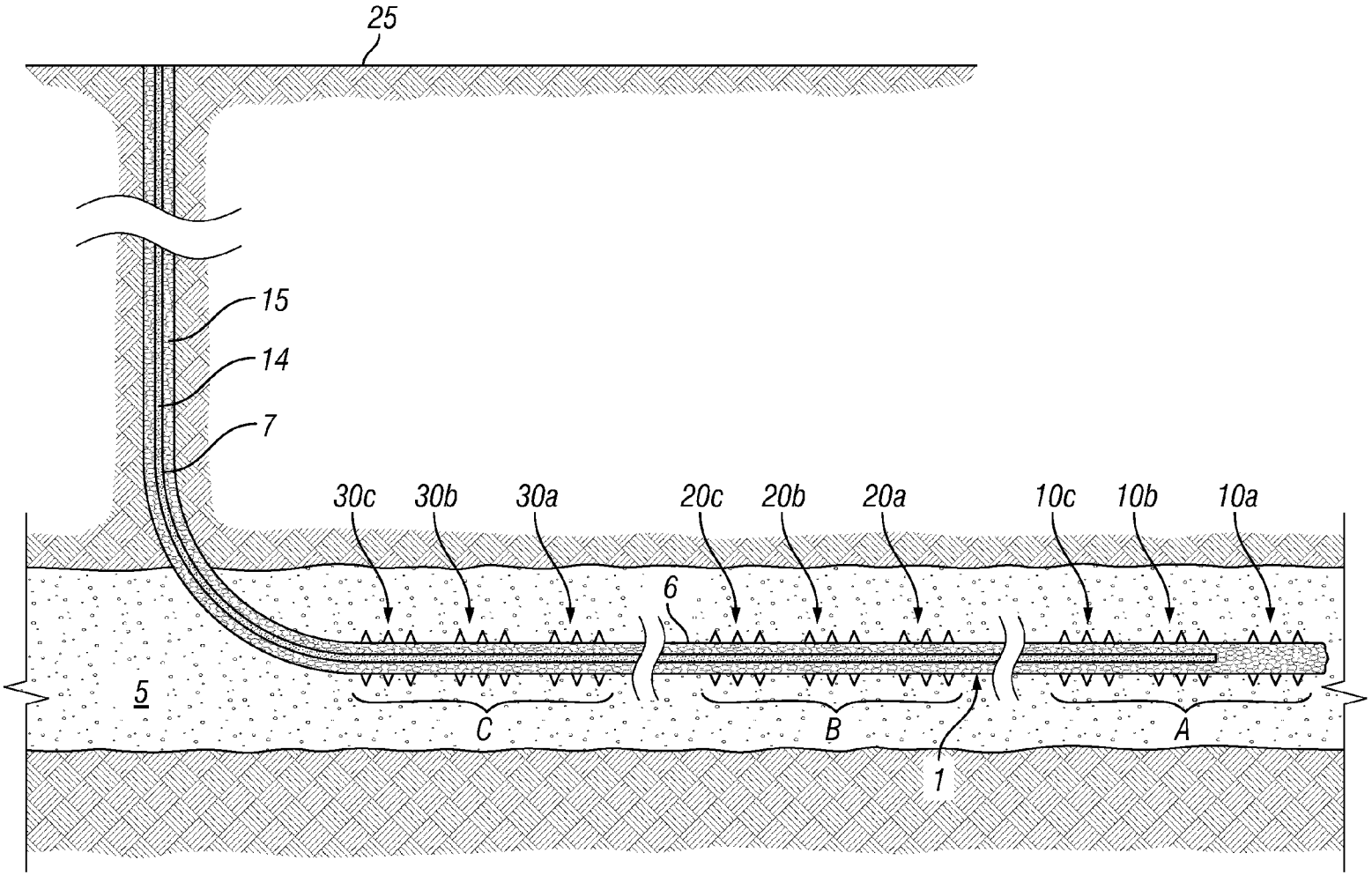
FIG. 1 shows a tubing string positioned in a portion of a multizone horizontal wellbore that includes a plurality of locations that previously have been hydraulically fractured.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a schematic of a multizone horizontal wellbore 1 within a well formation 5. The horizontal wellbore 1 includes a plurality of zones A, B, and C that each may contain a plurality of locations 10*a*, 10*b*, 10*c*, 20*a*, 20*b*, 20*c*, 30*a*, 30*b*, and 30*c* that have been previously fractured. The locations 10*a*, 10*b*, 10*c*, 20*a*, 20*b*, 20*c*, 30*a*, 30*b*, and 30*c* may be prior fractures, fracture clusters, or perforations within a casing. As discussed herein, each location may include one or more fracture clusters that have been previously fractured or were attempted to be previously fractured. Although the figures only show a multizone horizontal wellbore with cemented casing, the location may also be a fracture port in a ported completion that has been left open after a prior fracturing operation in an attempt to fracture the formation behind the fracture port. For example, the system and method disclosed herein may be used to re-fracture the formation 5 through the ported completion disclosed in U.S. patent application Ser. No. 12/842,099 entitled Bottom Hole Assembly With Ported Completion and Methods of Fracturing Therewith, filed on Jul. 23, 2010 by John Edward Ravensbergen and Lyle E. Laun that issued as U.S. Pat. No. 8,613,321 on Dec. 24, 2013, which is incorporated by reference herein in its entirety.

For illustrative purposes only, FIG. 1 shows three zones or segments of the multizone horizontal wellbore 1. Likewise, FIG. 1 shows three previously fractured locations per zone or segment, for illustrative purposes only. A multizone horizontal wellbore 1 may include a various number of zones or segments such as A, B, and C that have been previously fractured, as would be appreciated by one of ordinary skill in the art having the benefit of this disclosure. Likewise, the number of previously fractured locations within each zone or segment may vary. As discussed above, the previously hydraulically fractured locations may comprise a perforation through casing that was attempted to be fractured, a fracture or fracture cluster in the formation, or a fracture port in a completion. A previously fractured location includes any location within a wellbore that has been previously subjected to a fracturing treatment, in an attempt to fracture the formation at that location, whether or not the formation actually fractured. Hereinafter, the previously fractured locations will be referred to as a fracture cluster, but such locations should not be limited to those previously fractured locations that resulted in a fracture cluster and may include any of the above noted, or other fracture locations.

A production zone may have as few as a single fracture cluster or may include more than ten (10) fracture clusters. The multiple zones of a multizone horizontal wellbore 1 may include a plurality of fracture clusters 10, 20, and 30 that extend into the formation 5 that surrounds the casing 6 of the multizone horizontal wellbore 1. As discussed above, the formation 5 is fractured by a plurality of fracture clusters 10, 20, and 30 to increase the production of hydrocarbons from the wellbore. When the rate of production from the horizontal wellbore decreases below a minimum threshold value it may be necessary to re-fracture selected fracture clusters 10, 20, and 30 within the wellbore 1, as discussed herein.

A tubing string 7 may be positioned within the casing 6 of the horizontal wellbore 1. The tubing string 7 extends from the surface 25 to a desired location within the horizontal wellbore 1 to be re-fractured. The tubing string 7 may be comprised of various tubing strings such as jointed tubing or coiled tubing that may be used in the re-fracturing of desired locations within the horizontal wellbore 1, as discussed herein. The annulus between the tubing string 7 and the casing 6 contains a first fluid 15 and the coiled tubing contains a second fluid 14 as shown in FIG. 1. The first fluid 15 extends into the horizontal wellbore 1 beyond the end of tubing string 7. The first fluid 15 within the annulus will have a higher viscosity than the second fluid 14 in the tubing string 7.

Figure 2:
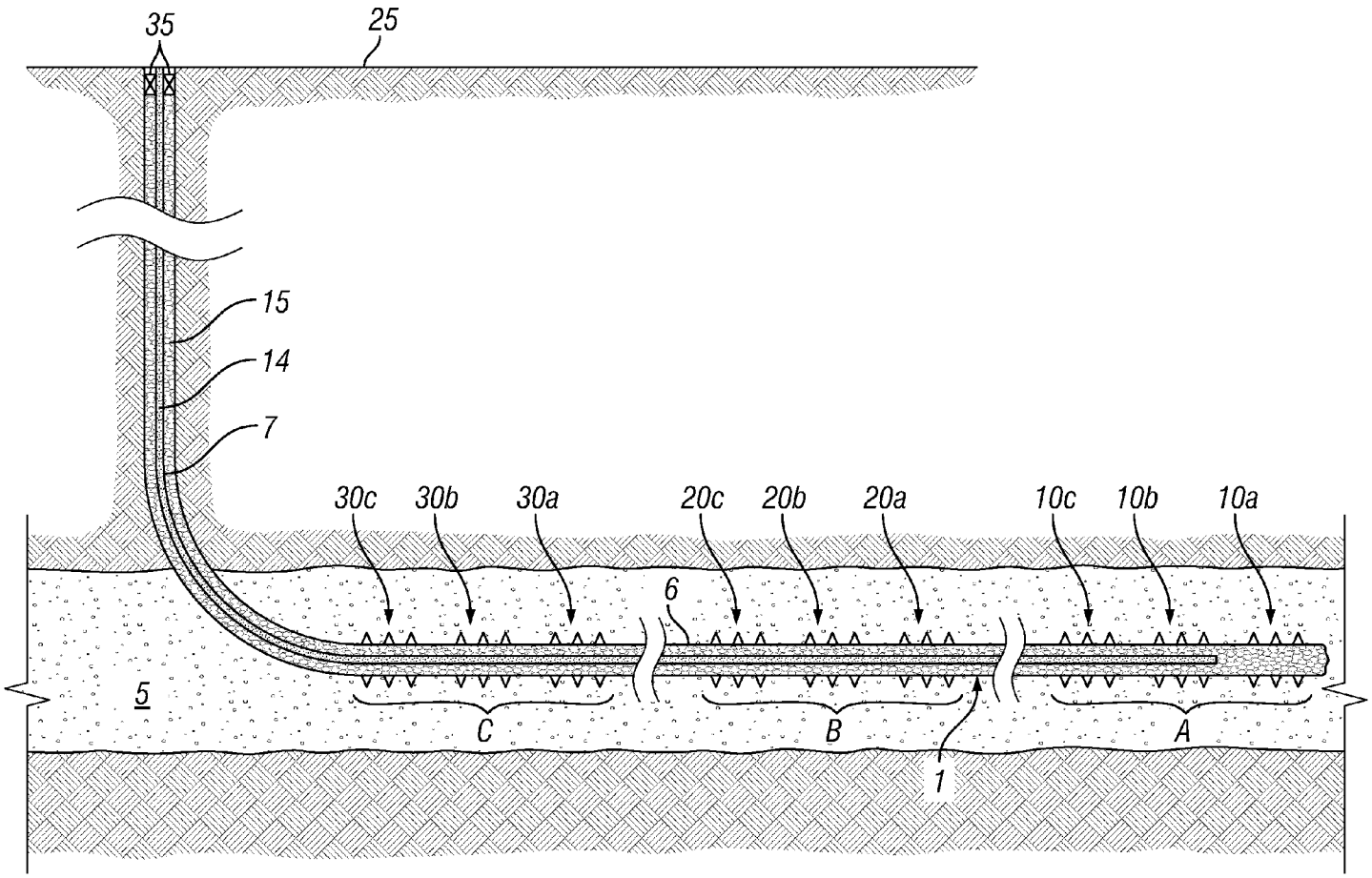
FIG. 2 shows a tubing string positioned in a portion of a multizone horizontal wellbore that includes a plurality of locations that previously have been hydraulically fractured with the annulus between the tubing string and the wellbore isolated at the surface.

FIG. 2 shows that one or more isolation elements 35, such as a packer, may be actuated at or near the surface 25 to seal off the annulus between the tubing string 7 and the casing 6. This will prevent the upward movement of the first fluid 15 within the annulus. The hydrostatic pressure of the first fluid 15 in the annulus having a higher viscosity may then be used to prevent the flow of the second fluid 14 up the annulus as it exits the end of the tubing string 7, as described herein. Thus, the first fluid 15 may divert the second fluid 14 to location to be re-fractured.

Figure 3:
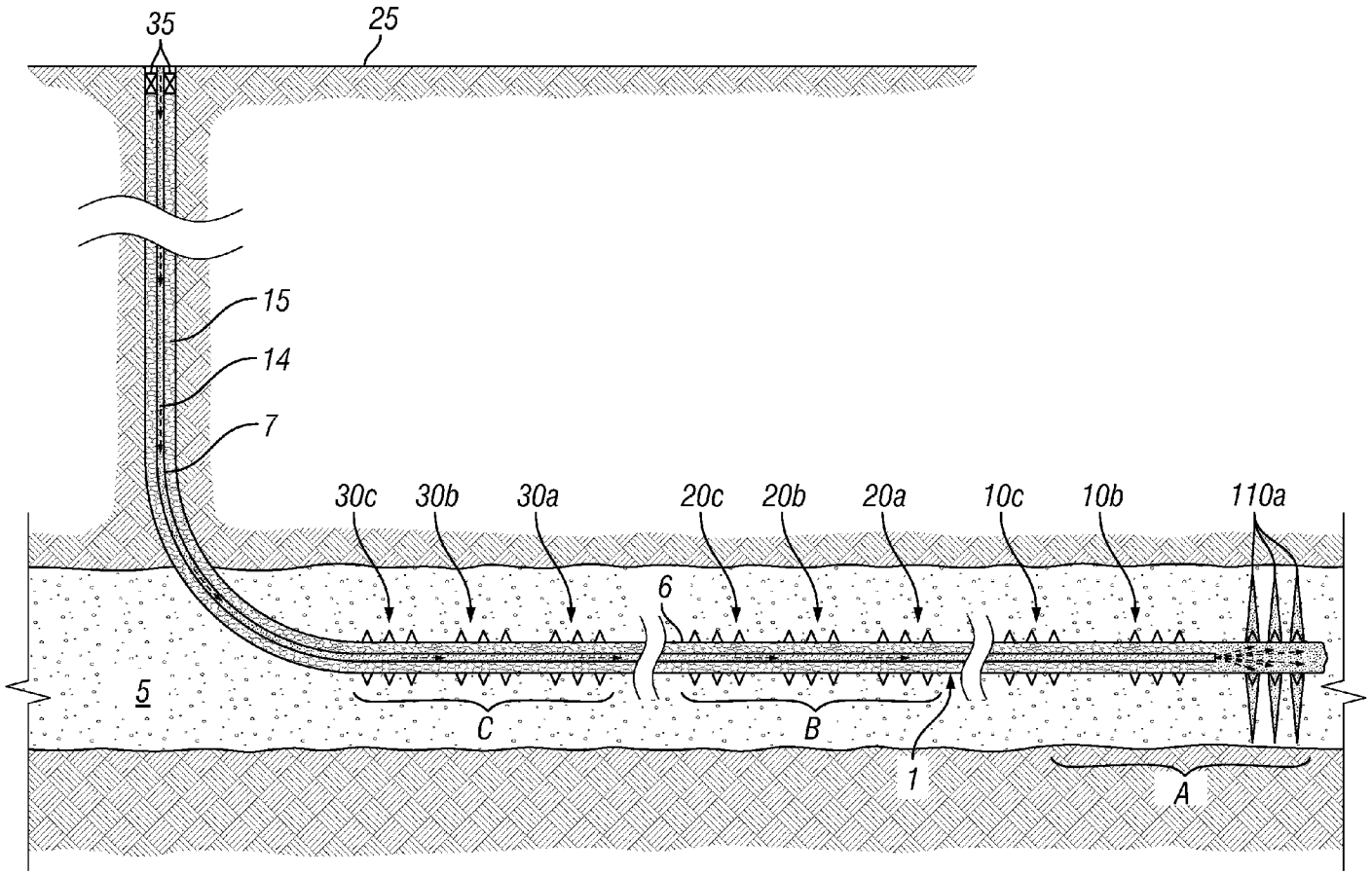
FIG. 3 shows a tubing string positioned in a portion of a multizone horizontal wellbore with a second fluid being pumped down the tubing string to start the initiation of re-fracturing of a location within the horizontal wellbore.
Figure 4:
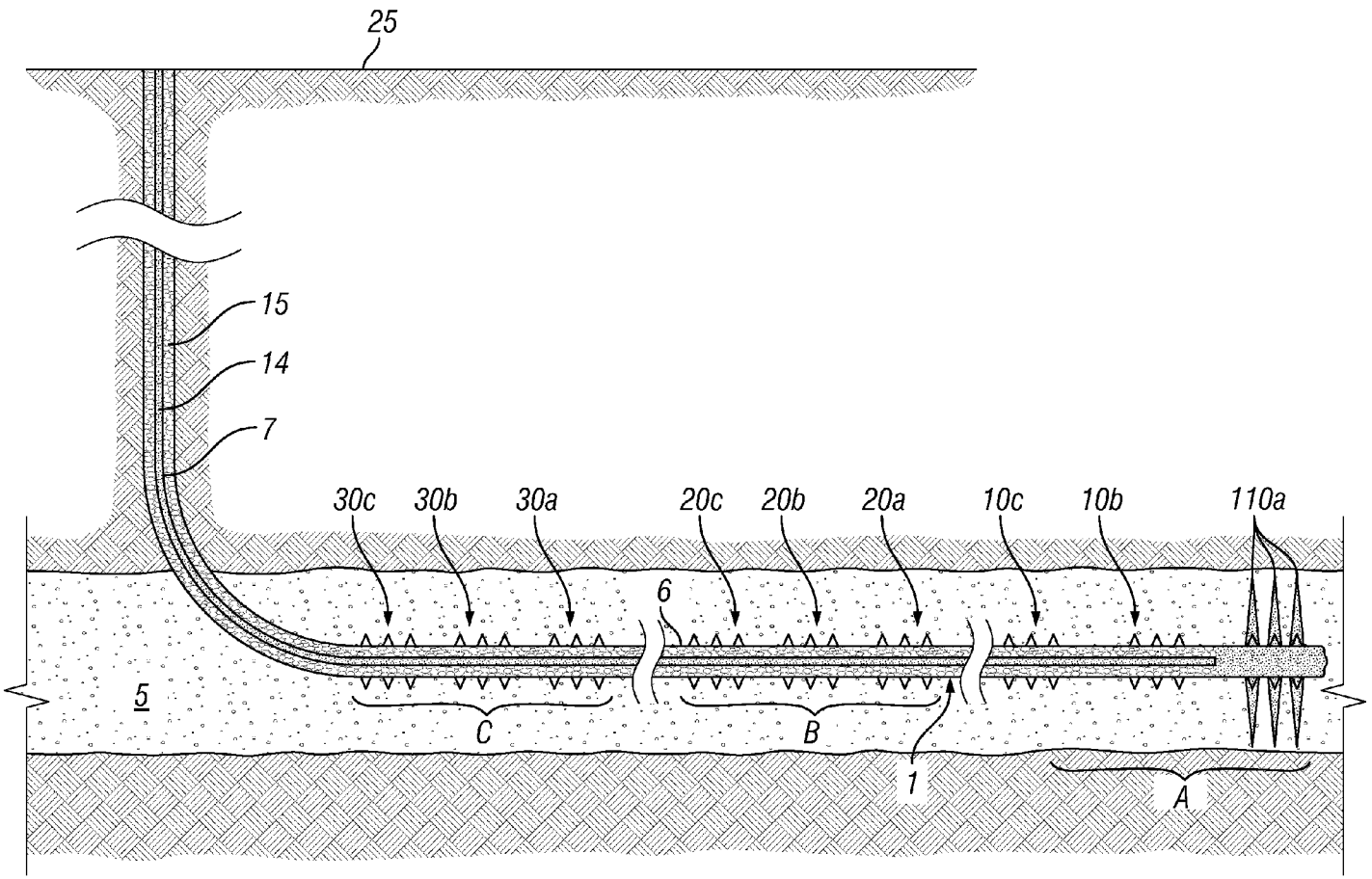
FIG. 4 shows a tubing string positioned in a portion of a multizone horizontal wellbore that includes a plurality of locations that previously have been hydraulically fractured with the annulus between the tubing string and the wellbore no longer isolated at the surface.

FIG. 3 shows the initiation of re-fracturing a first location 110*a*. A second fluid 14 is pumped down the tubing string 6 as indicated by arrows shown in FIG. 3. With the isolation element 35 actuated, the hydrostatic pressure of the first fluid 14 in the annulus between the tubing string 7 and the casing 6 diverts the second fluid 14 as it exits the end of the tubing string 7 to initiate the re-fracture at the first location 110*a* rather than flowing up the annulus. After the re-fracture of the first previously fracture location 110*a* has been initiated, the second fluid 14 is no longer pumped down the tubing string 7 and the isolation element(s) 35 are unset as shown in FIG. 4.

Figure 5:
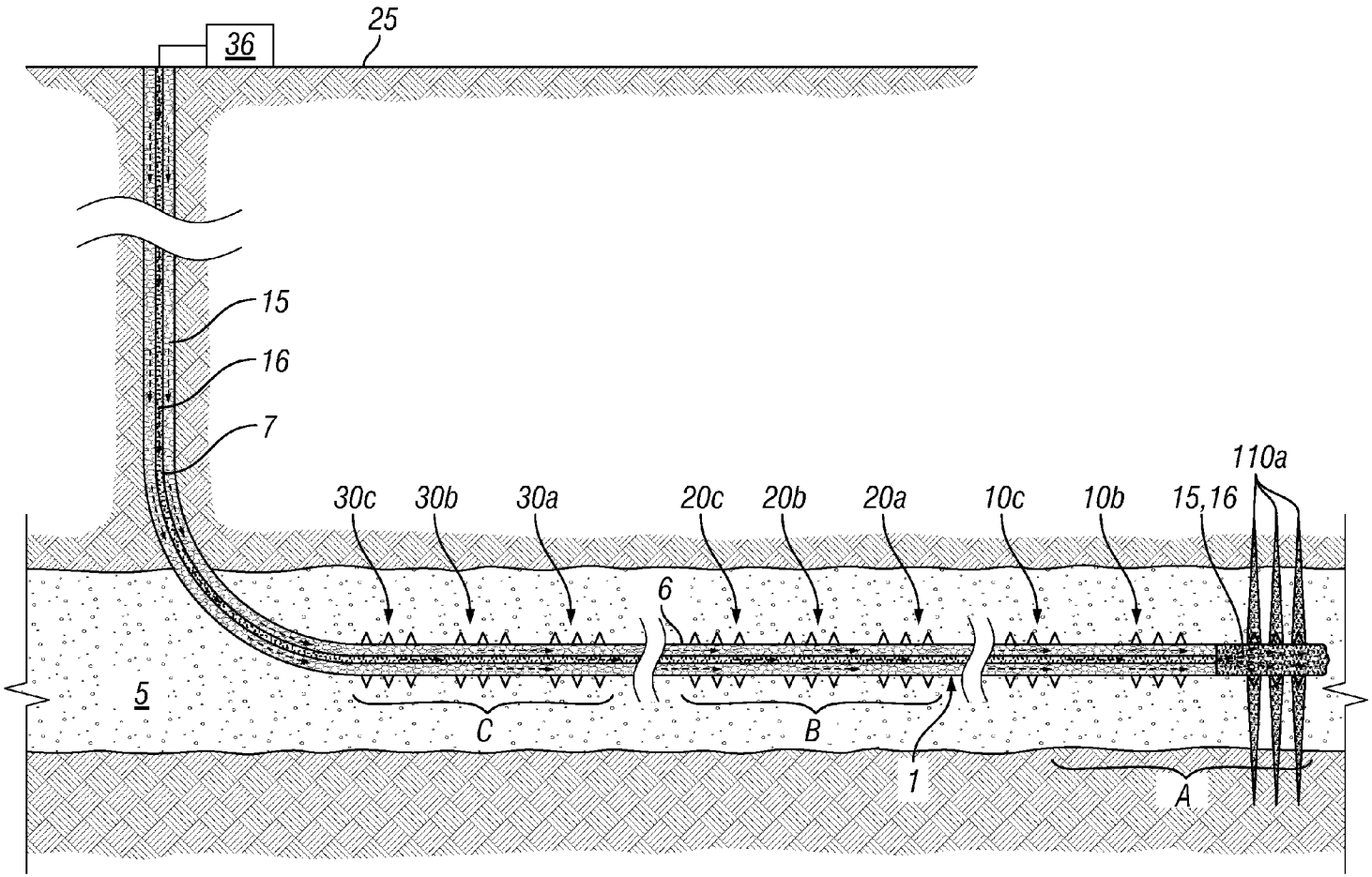
FIG. 5 shows a tubing string positioned in a portion of a multizone horizontal wellbore with a first fluid being pumped down the annulus and a third fluid being pumped down the tubing string to re-fracture a location within the horizontal wellbore.

FIG. 5 shows the re-fracturing a previously fractured first location 110*a* by the pumping of the first fluid 15 down the annulus as indicated by the arrows. The second fluid 14 in the tubing string 7 has been replaced with a third fluid 16, and the third fluid 16 is pumped down the tubing string 7 simultaneously as the first fluid 15 is pumped down the annulus as indicated by the arrows within the tubing string 7. The pumping of the first fluid 15 and the third fluid 16 re-fractures the location 110*a* within the horizontal wellbore 1. The third fluid 16 may have a higher viscosity than the second fluid 15 previously contained within the tubing string 7. The third fluid 16 may be the same first fluid 15. During the re-fracturing of a location within the horizontal wellbore 1 a microseismic device 36 may be used to monitor the process. The microseismic device 36 may be located at the surface 25, as shown in FIG. 5, or may be positioned within an off-set wellbore. Data from the microseismic device 36 may provide information concerning the effectiveness of the re-fracturing procedure and/or information concerning development of a fracture in an undesired location of the horizontal wellbore 1. The operator may then make adjustments to the re-fracturing procedure based on analysis of the data.

Various fluids may be used for the first fluid 15, second fluid 14, and third fluid 16 during the re-fracturing of a location within a horizontal wellbore 1. Preferably, the first fluid 15 has a viscosity of ten (10) centipoise or greater and has a viscosity that is at least five (5) centipoise greater than the viscosity of the second fluid 14. The third fluid 16 preferably has a greater viscosity than the second fluid and even may be the same fluid as the first fluid 15. The first fluid 16 may be various linear gels. For example, the first fluid 16 may be water containing a gelling agent such as guar, HPG, CMHPG, or xanthan. The first and third fluids 15 and 16 preferably have a viscosity between ten (10) centipoise and thirty (30) centipoise.

Figure 6:
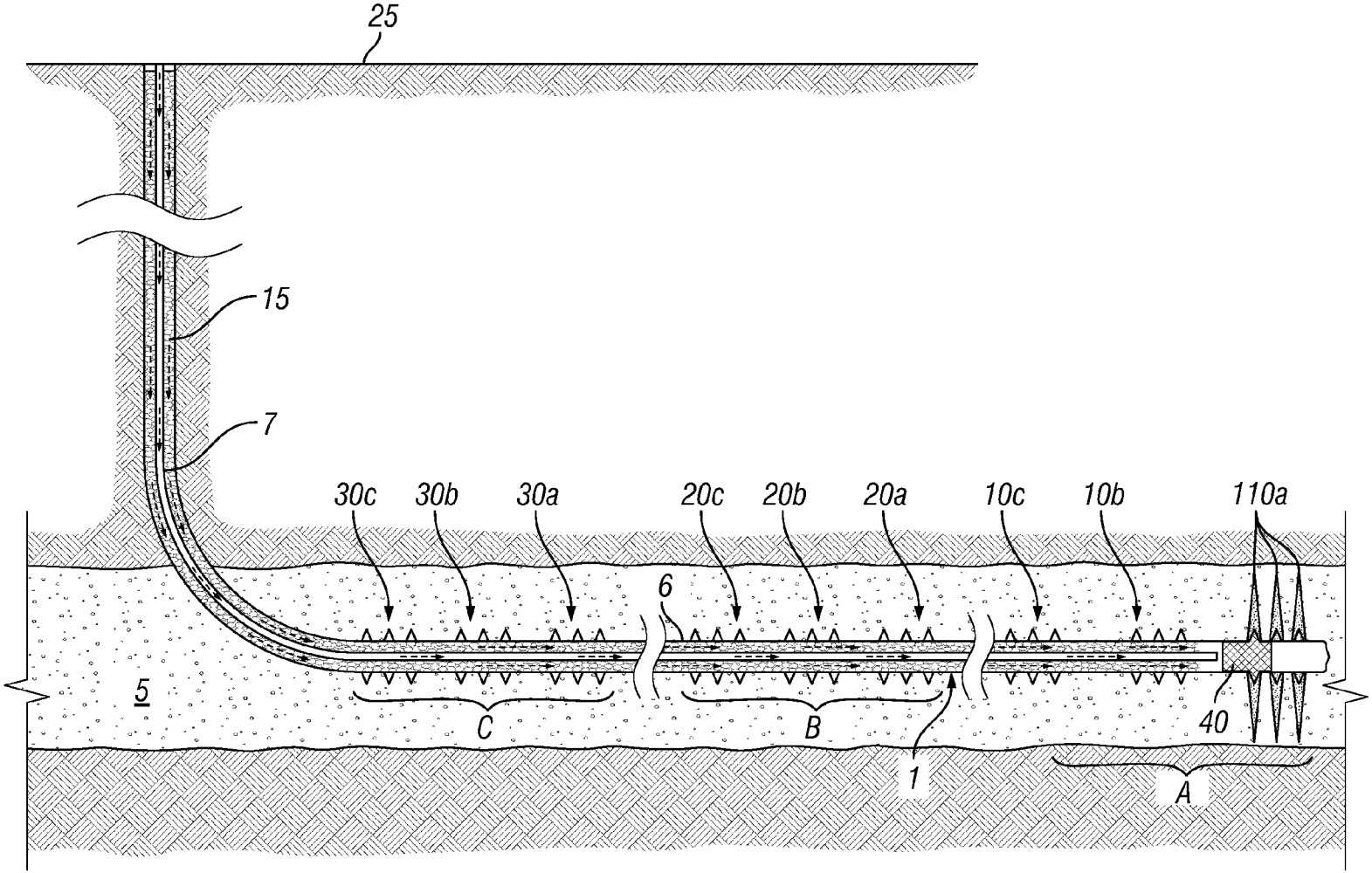
FIG. 6 shows a tubing string positioned in a portion of a multizone horizontal wellbore with a plug beginning to be formed to isolate a location within the horizontal wellbore that has been re-fractured.
Figure 7:
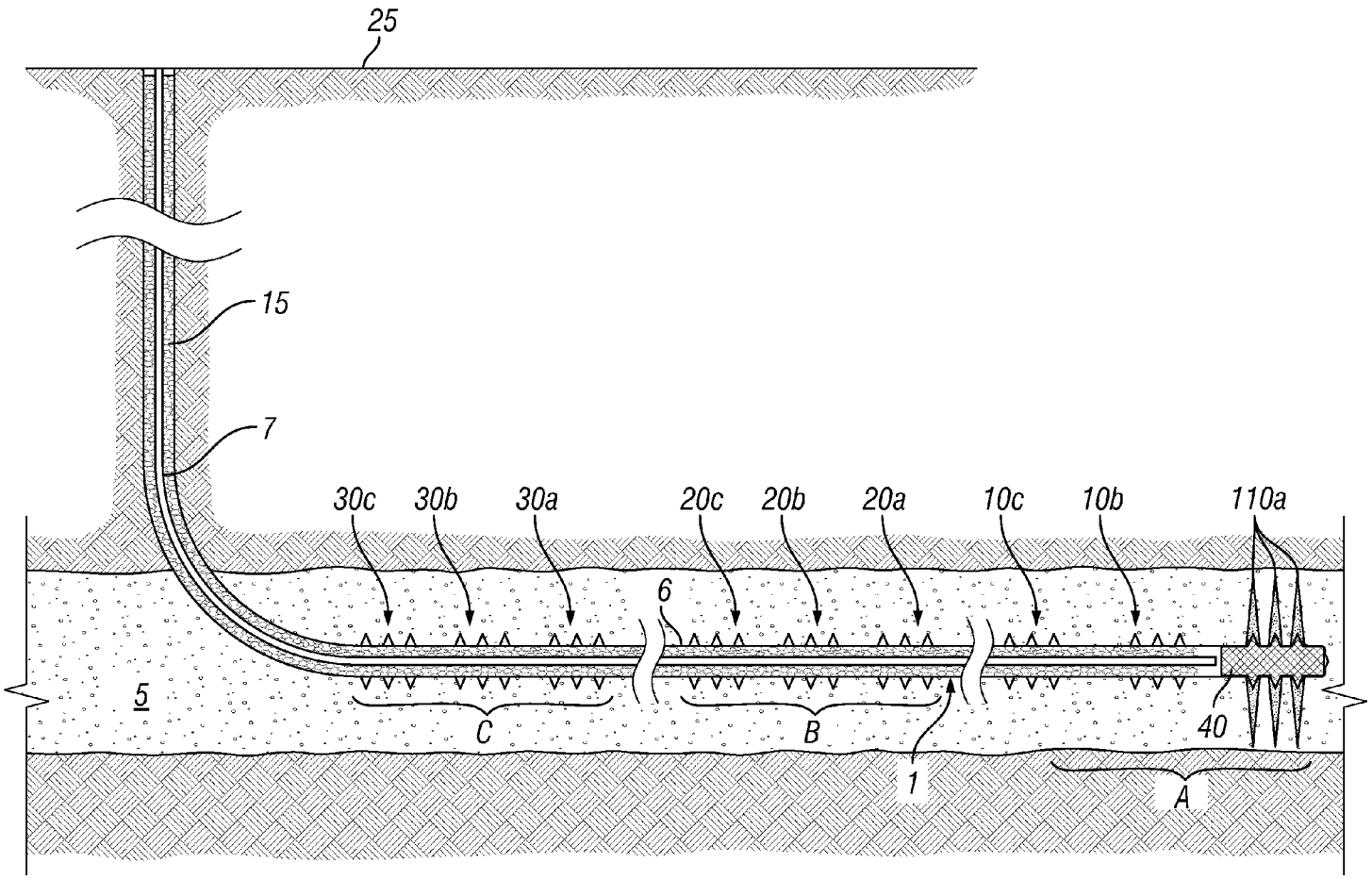
FIG. 7 shows a tubing string positioned in a portion of a multizone horizontal wellbore with a plug isolating a location within the horizontal wellbore that has been re-fractured.

After the first location 110*a* has been re-fractured, the first location 110*a* may need to be isolated to permit the re-fracturing of another location, such as 10*b*, within the wellbore 1. Diverting material may be pumped down the tubing string 7 to form a plug adjacent the first location 110*a*. FIG. 6 shows the start of the formation of a plug 40 and FIG. 7 shows a plug 40 formed adjacent the first location 110*a* to isolate the re-fractured location from the rest of the horizontal wellbore 1. Various mechanism and materials may be used to isolate the re-fractured location from the wellbore 1 as would be appreciated by one of ordinary skill in the art having the benefit of this disclosure. For example, a plug may be formed in the wellbore as disclosed in U.S. patent application Ser. No. 14/323,804 entitled Hydraulic Fracturing Isolation Methods and Well Casing Plugs for Re-Fracturing Horizontal Multizone Wellbores filed on Jul. 3, 2014 and published as U.S. Patent App. Pub. No. 2016/0003021 on Jan. 7, 2016, which is incorporated by reference herein in its entirety.

Figure 8:
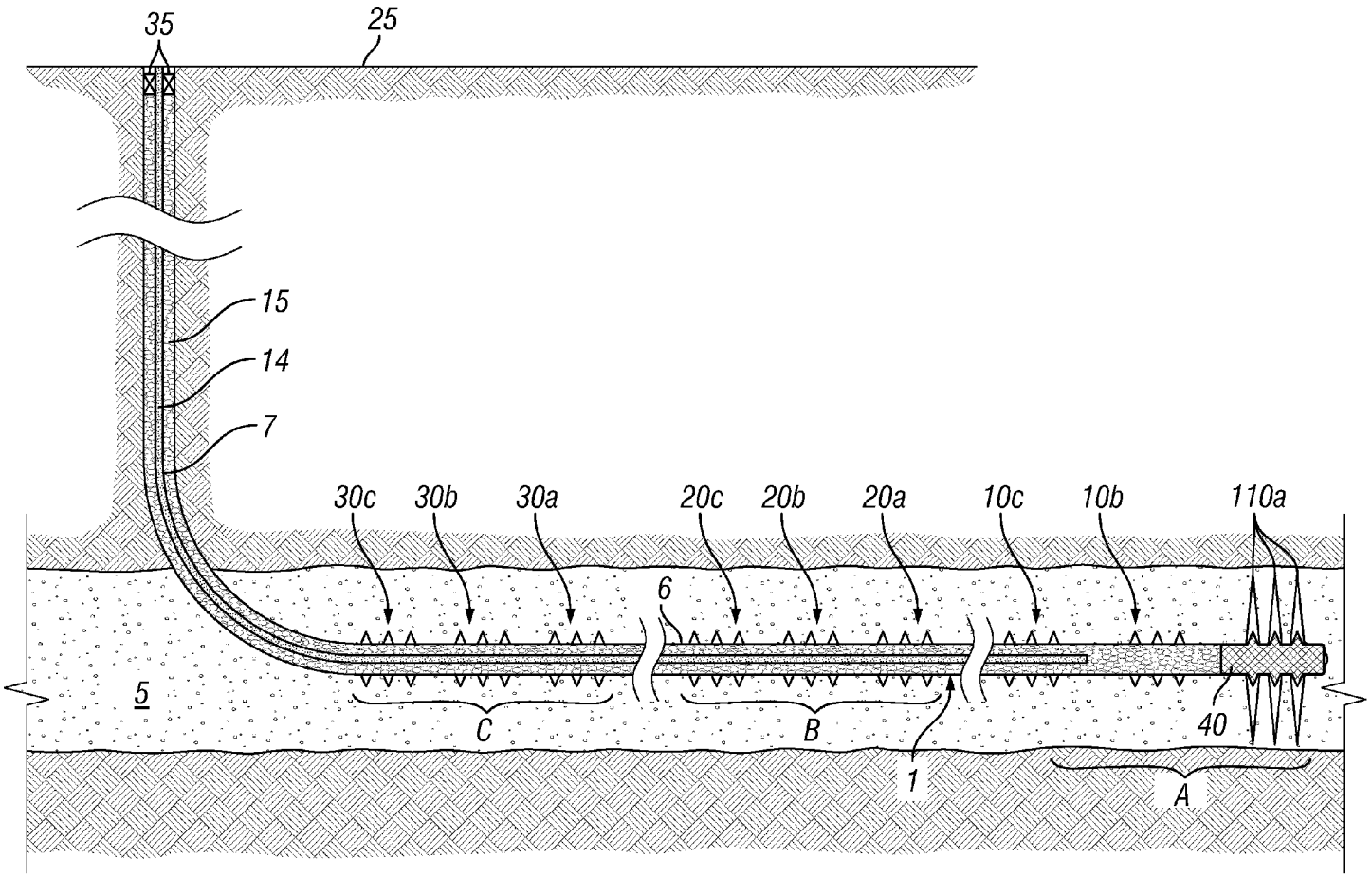
FIG. 8 shows a tubing string positioned in a portion of a multizone horizontal wellbore that includes a plurality of locations that previously have been hydraulically fractured.
Figure 9:
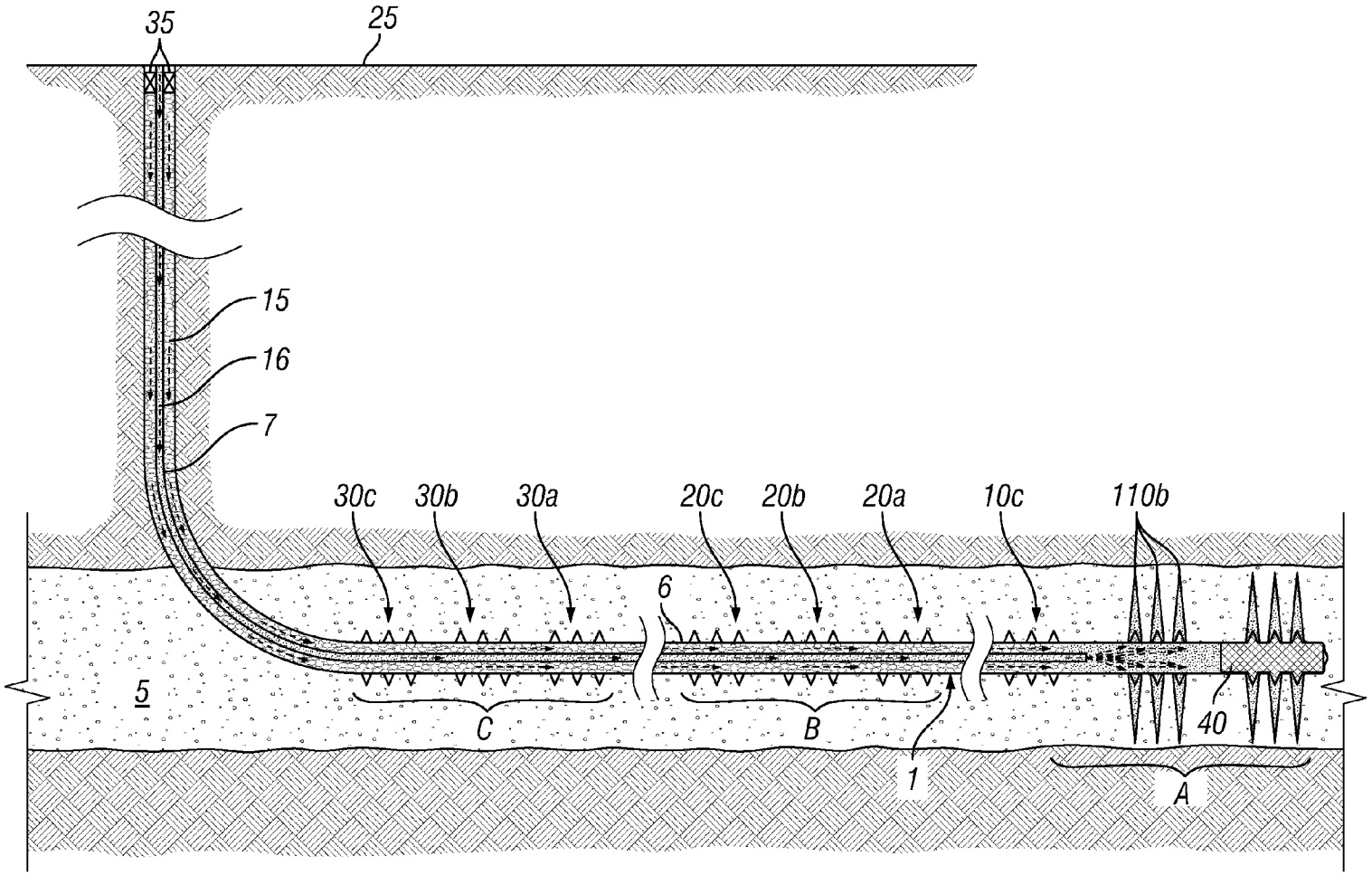
FIG. 9 shows a tubing string positioned in a portion of a multizone horizontal wellbore with a first fluid being pumped down the annulus and a third fluid being pumped down the tubing string to re-fracture a location within the horizontal wellbore.
Figure 10:
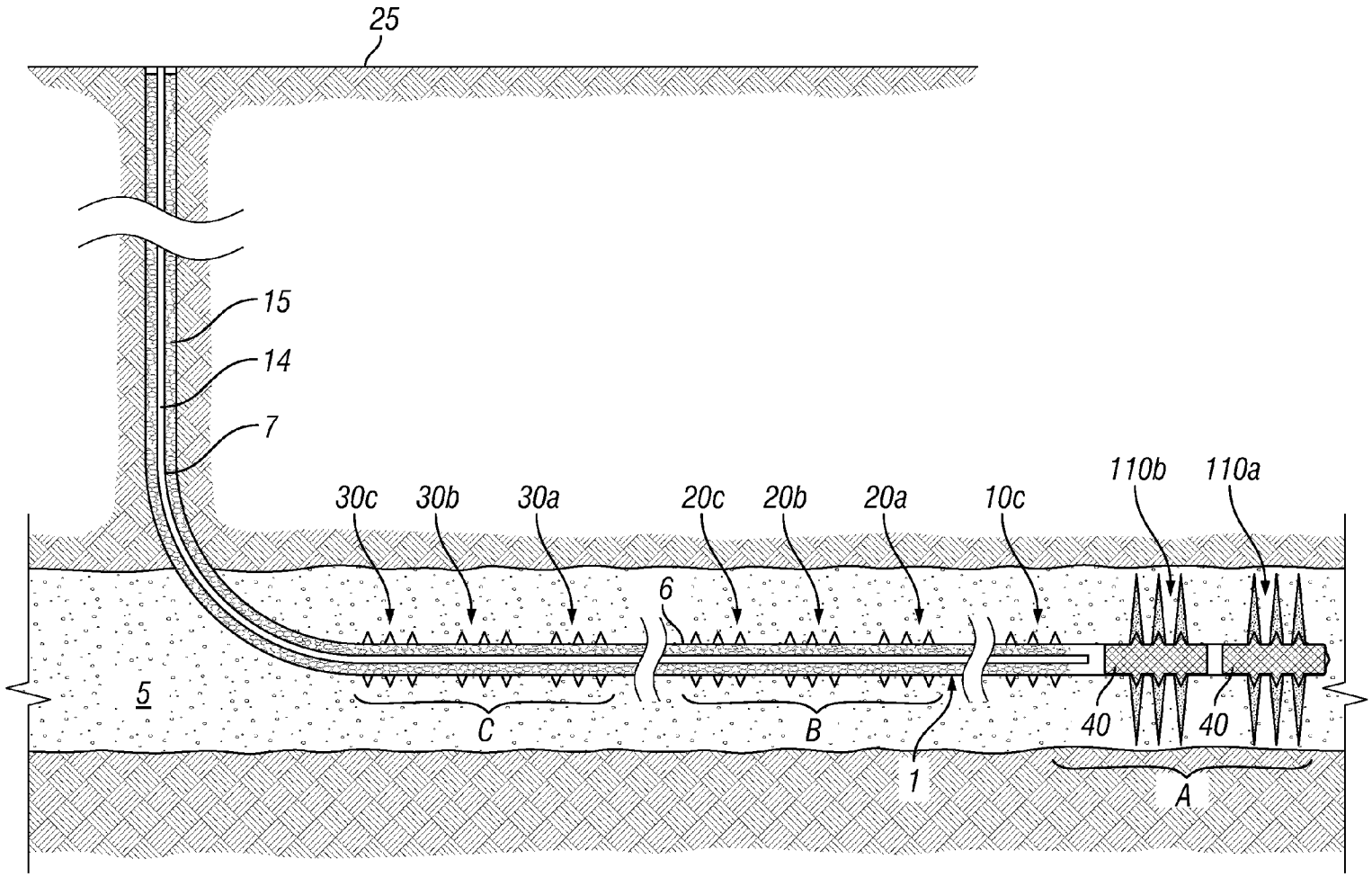
FIG. 10 shows a tubing string positioned in a portion of a multizone horizontal wellbore with multiple plugs isolating locations within the horizontal wellbore that have been re-fractured.

After the re-fractured first location 110*a* has been isolated, the end of the tubing string 7 may be moved to be adjacent a second location 10*b* in the horizontal wellbore 1 as shown in FIG. 8. The second location may be the next previously hydraulically fractured location along the wellbore 1 or may be a different previously hydraulically location within the wellbore 1. The isolation device(s) 35 would then be actuated to close off the annulus at the surface 25 and the re-fracturing initiated by pumping a second fluid 14 down the tubing string 7 as discussed above. After initiated the re-fracturing of the second location, the isolation device(s) 35 are unset and the second location 110*b* is re-fractured by pumping a first fluid 15 down the annulus and a third fluid 16 down the tubing string 7 as shown in FIG. 9. The second location 110*b* may then be isolated by locating a plug 40 adjacent the second location 110*b* and the end of the tubing string 7 may be positioned adjacent the next location of the wellbore 1 to be re-fractured.

Figure 11:
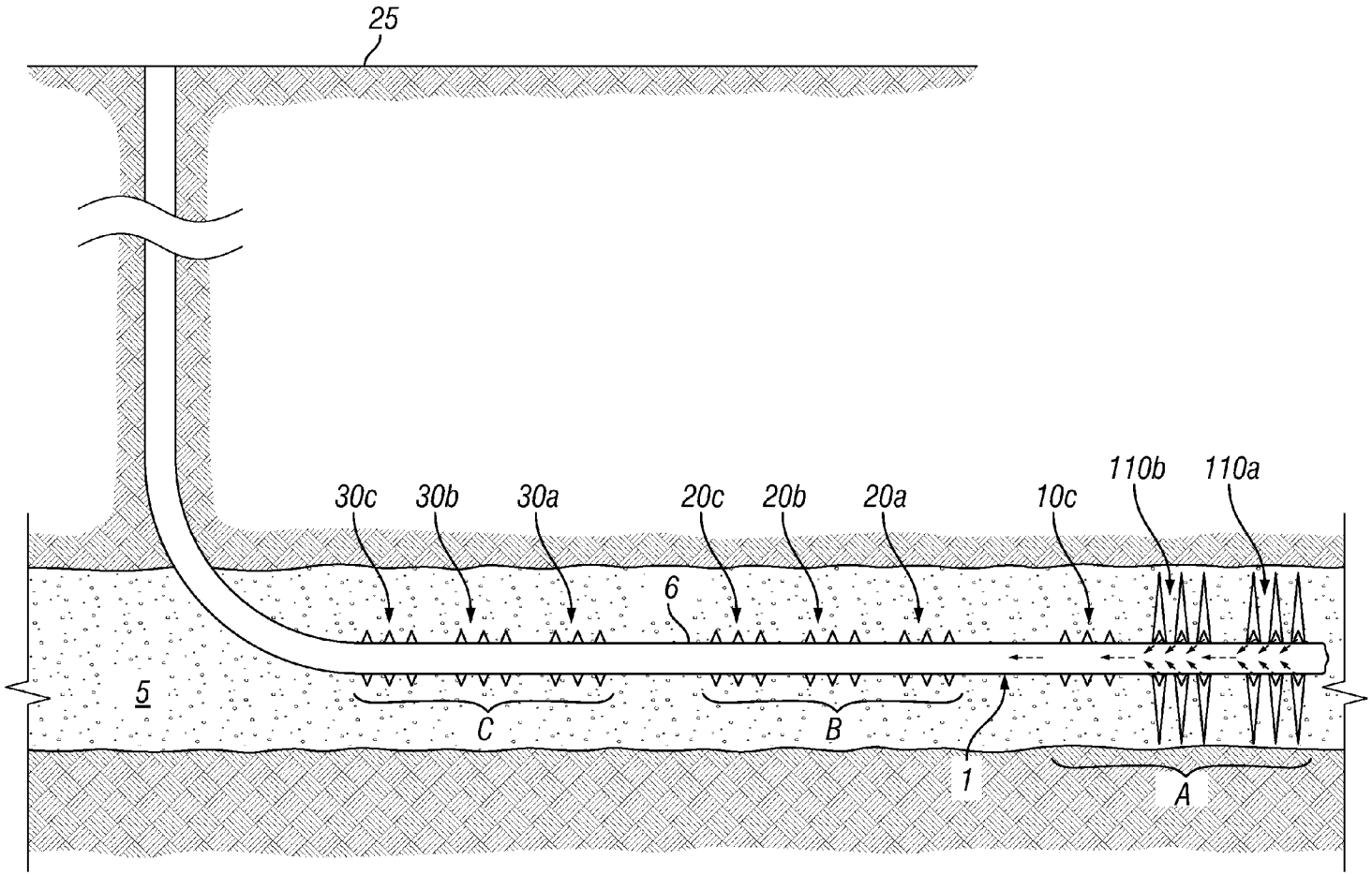
FIG. 11 shows producing from multiple locations of a multizone horizontal wellbore that have been re-fractured.
Figure 12:
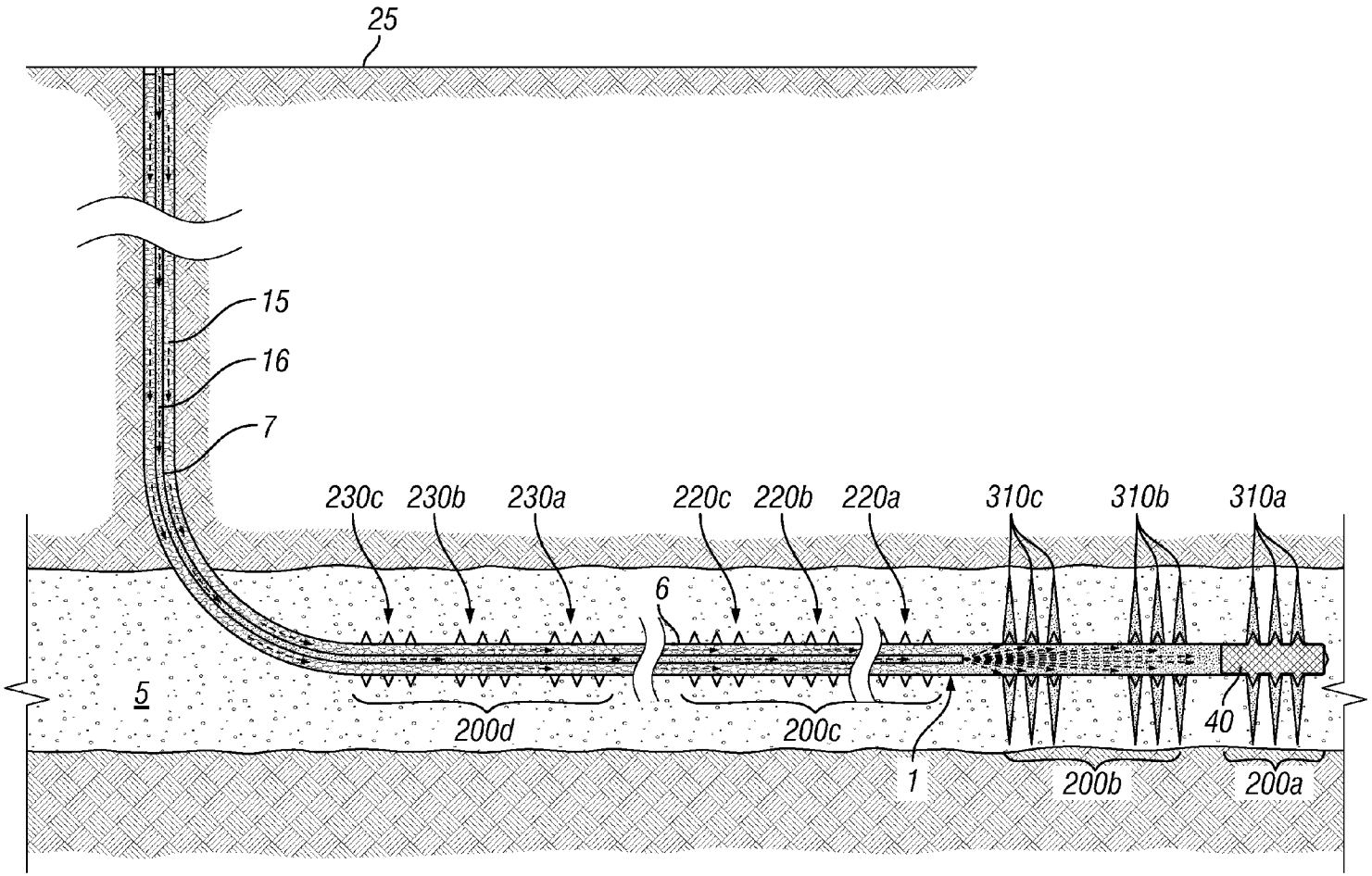
FIG. 12 shows a tubing string positioned in a portion of a multizone horizontal wellbore with a first fluid being pumped down the annulus and a third fluid being pumped down the tubing string to re-fracture multiple locations within the horizontal wellbore.

After all of the desired locations have been re-fractured, the plugs 40 may be removed from the wellbore 1 to produce hydrocarbons from the re-fractured locations. For example, FIG. 11 shows that the tubing string 7 has been removed from the wellbore 1 as well as the plugs 40 having been removed from the first re-fractured location 110*a* and the second re-fractured location 110*b*, permitting the production of hydrocarbons for the re-fractured locations. A first fluid 15 may be pumped down the annulus and a third fluid may be pumped down the tubing string 7 to re-fracture two previously fractured locations 310*b* and 310*c* at the same time as shown in FIG. 12. FIG. 12 shows a schematic of a multizone horizontal wellbore 1 within a well formation 5. The horizontal wellbore 1 includes a plurality of zones 200*a*, 200*b*, 200*c*, and 200*d* that each may contain a plurality of locations 220*a*, 220*b*, 220*c*, 230*a*, 230*b*, and 230*c* that have been previously fractured. The locations 220*a*, 220*b*, 220*c*, 230*a*, 230*b*, and 230*c* may be prior fractures, fracture clusters, or perforations within a casing. A first fluid 15 may be pumped down the annulus and a third fluid may be pumped down the tubing string 7 to re-fracture two previously fractured locations 310*b* and 310*c* at the same time as shown in FIG. 12. A plug 40 may isolate a previously re-fractured location 310*a* from the fluid 15 pumped down to re-fracture the two previously fractured locations 310*b* and 310*c*.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A method of re-fracturing a horizontal wellbore comprising:

extending a tubing string into a horizontal wellbore from a surface location;

positioning an end of the tubing string adjacent a first location within the horizontal wellbore, the first location having been previously hydraulically fractured at least once to form a fracture that extends into a subterranean formation at the first location prior to extending the tubing string into the horizontal wellbore, the tubing string extending from the surface location to the first location;

providing a first fluid in an annulus between the tubing string and the horizontal wellbore, wherein a portion of the horizontal wellbore beyond an end of the tubing string includes the first fluid;

providing a second fluid within the tubing string, wherein the second fluid differs from the first fluid;

sealing the annulus adjacent to the surface location; and pumping the second fluid down the tubing string to initiate a re-fracture of the fracture that extends into the subterranean formation at the first location while the annulus is sealed adjacent to the surface location.

2. The method of claim 1, further comprising unsealing the annulus adjacent to the surface location after initiating the re-fracture of the first location.

3. The method of claim 2, further comprising pumping the first fluid down the annulus to re-fracture the first location and pumping a third fluid down an interior of the tubing string to re-fracture the first location, wherein the first fluid is pumped down the annulus and the third fluid is pumped down the tubing string after unsealing the annulus.

4. The method of claim 3, further comprising monitoring the first location with a microseismic device and determining an effectiveness of the re-fracturing based on data from the microseismic device.

5. The method of claim 3, wherein the third fluid is same as the first fluid.

6. The method of claim 3, further comprising hydraulically isolating the first location from the horizontal wellbore after being re-fractured by the first fluid and the third fluid.

7. The method of claim 6, wherein hydraulically isolating the first location further comprises forming a plug within the horizontal wellbore adjacent the first location.

8. The method of claim 7, wherein forming the plug further comprises pumping fluid down the tubing string to form the plug.

9. The method of claim 6, further comprising:

positioning the end of the tubing string adjacent a second location within the horizontal wellbore, the second location having been previously hydraulically fractured at least once to form a fracture that extends into a subterranean formation at the second location prior to extending the tubing string into the horizontal wellbore, the tubing string extending from the surface location to the second location;

providing the first fluid in the annulus between the tubing string and the horizontal wellbore;

providing the second fluid within the tubing string, wherein the second fluid differs from the first fluid;

sealing the annulus adjacent to the surface location; and pumping the second fluid down the tubing string to initiate a re-fracture of the fracture that extends into the subterranean formation at the second location while the annulus is sealed adjacent to the surface location.

10. The method of claim 9, further comprising unsealing the annulus adjacent to the surface location after initiating the re-fracture of the second location.

11. The method of claim 10, further comprising pumping the first fluid down the annulus to re-fracture the second location and pumping the third fluid down the tubing string to re-fracture the second location, wherein the first fluid is pumped down the annulus and the third fluid is pumped down the tubing string after unsealing the annulus.

12. The method of claim 11, further comprising hydraulically isolating the second location from the horizontal wellbore after being re-fractured by the first fluid and the third fluid.

13. The method of claim 12, further comprising unisolating the first location, unisolating the second location, and producing hydrocarbons from the first and second locations.

14. A system for re-fracturing a multizone horizontal wellbore comprising:

a tubing string positioned within a multizone horizontal wellbore, the tubing string extends from a surface location with an end being positioned adjacent to a first location in the multizone horizontal wellbore, the first location being a previously hydraulically fractured, prior to the tubing string being positioned within the multizone horizontal wellbore, to form a fracture that extends into a subterranean formation at the first location;

a sealing element, the sealing element configured to selectively create a seal in an annulus between the tubing string and the wellbore, the seal being adjacent the surface location;

a first fluid in the annulus and in a portion of the wellbore beyond the end of the tubing string;

a second fluid within an interior of the tubing string, wherein the second fluid is pumped out the tubing string to initiate a re-fracture of the fracture that extends into the subterranean formation at the first location;

a third fluid within the interior of the tubing string, the third fluid replacing the second fluid, wherein the first fluid is pumped down the annulus and the third fluid is pumped down the tubing string to re-fracture the first location; and a first plug positioned adjacent the first location after being re-fractured by the first fluid and the third fluid.

15. The system of claim 14, wherein the first fluid has a viscosity of at least ten centipoise.

16. The system of claim 14, wherein the first fluid has a first viscosity and the second fluid has a second viscosity and wherein the first viscosity is at least five centipoise higher than the second viscosity.

17. The system of claim 14, wherein the first fluid has a first viscosity, the second fluid has a second viscosity, and third fluid has a third viscosity and wherein the third viscosity is the same as the first viscosity and wherein the first viscosity is at least five centipoise higher than the second viscosity.

18. The system of claim 14, wherein the tubing string is a coiled tubing string.

19. The system of claim 14, wherein the first fluid comprises a linear gel.

20. The system of claim 14, further comprising a micro-seismic device configured to monitor the re-fracture of the first location.

* * * * *